US008292675B2

(12) United States Patent
Zhang

(10) Patent No.: US 8,292,675 B2
(45) Date of Patent: Oct. 23, 2012

(54) ELECTRICAL CONNECTOR HAVING IMPROVED BLOCKING MEMBER

(75) Inventor: Dao-Kuan Zhang, Kunshan (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 13/159,461

(22) Filed: Jun. 14, 2011

(65) Prior Publication Data

US 2011/0306222 A1 Dec. 15, 2011

(30) Foreign Application Priority Data

Jun. 15, 2010 (CN) ..... 2010 2 0226107

(51) Int. Cl.
*H01R 13/64* (2006.01)

(52) U.S. Cl. ..... 439/677

(58) Field of Classification Search ..... 439/677, 439/676

See application file for complete search history.

(56) References Cited

U.S. PATENT DOCUMENTS

| | | | | |
|---|---|---|---|---|
| 6,257,935 | B1 * | 7/2001 | Zhang et al. | 439/680 |
| 6,312,293 | B1 * | 11/2001 | Wang | 439/677 |
| 6,935,900 | B2 * | 8/2005 | Wan et al. | 439/677 |
| 6,966,798 | B1 * | 11/2005 | Wu | 439/677 |

* cited by examiner

*Primary Examiner* — Phuong Dinh

(74) *Attorney, Agent, or Firm* — Ming Chieh Chang; Wei Te Chung

(57) ABSTRACT

An electrical connector (100) for insertion of a first plug (800) along a mating direction. The electrical connector includes an insulative housing (1) and a contact module (3) assembled to the insulative housing. The insulative housing includes an opening (10), a receiving cavity (11) and a pair of blocking member (14) provided in the receiving cavity. The blocking member includes a guiding portion adjacent to the opening, and a resilient portion (141) projecting more inwardly to the receiving cavity along a transverse direction perpendicular to the mating direction than the guiding portion, to thereby form a shoulder portion (144) facing to the opening between the guiding portion and the resilient portion. The resilient portion is deformable sidewardly along the transverse direction.

5 Claims, 6 Drawing Sheets

ELECTRICAL CONNECTOR HAVING IMPROVED BLOCKING MEMBER

BACKGROUND OF THE INVENTION

1. Field of the Invention

The present invention relates to an electrical connector, and more particularly to a modular jack connector adapted for accommodating a modular jack plug and capable of preventing an insertion of a USB (Universal Serial Bus) plug.

2. Description of Related Art

U.S. Pat. No. 6,257,935 issued to Zhang on Jul. 10, 2001 discloses an electrical connector comprising an insulative housing defining a cavity, a contact module received in the cavity of the insulative housing, and a shielding shell attached to the insulative housing. The insulative housing has a pair of blocking members formed therein. Each blocking member includes a resilient portion and a blocking portion. When a modular jack plug having a standard width is inserted into the cavity of the insulative housing, the resilient portions are depressed sidewardly for permitting further insertion of the modular jack plug.

When a USB plug having a width larger than the standard width is inserted into the cavity slightly obliquely, the resilient portions may be depressed sidewardly by the USB plug to allow the insertion of the USB plug. Undesired mis-insertion of the USB plug would result in short circuit and the USB plug may be destroyed.

An electrical connector having improved blocking member is desired.

SUMMARY OF THE INVENTION

Accordingly, an object of the present invention is to provide an electrical connector including blocking member capable of allowing an insertion of a modular jack plug and capable of stopping insertion of a USB plug.

In order to achieve the object set forth, an electrical connector for insertion of a first plug having a first width along a mating direction. The electrical connector includes an insulative housing and a contact module assembled to the insulative housing. The insulative housing includes an opening, a receiving cavity and a pair of blocking member provided in the receiving cavity. Each blocking member includes a guiding portion adjacent to the opening, and a resilient portion projecting more inwardly to the receiving cavity along a transverse direction perpendicular to the mating direction than the guiding portion, to thereby form a shoulder portion facing to the opening between the guiding portion and the resilient portion. The first width of the first plug is not larger than the first distance between the pair of guiding portions. The resilient portion is deformable sidewardly along the transverse direction.

The resilient portions of the blocking members are depressed sidewardly by the first plug, i.e., the RJ45 plug, for permitting an insertion of the first plug to a final position. Additionally, the second plug, i.e., the USB plug, having a width larger than that of the first plug would be blocked by the shoulder portions of the blocking members. Therefore, it would prevent the short circuit and would protect the second plug from being destroyed.

Other objects, advantages and novel features of the invention will become more apparent from the following detailed description when taken in conjunction with the accompanying drawings.

DETAILED DESCRIPTION OF THE PREFERRED EMBODIMENT

Figure 1:
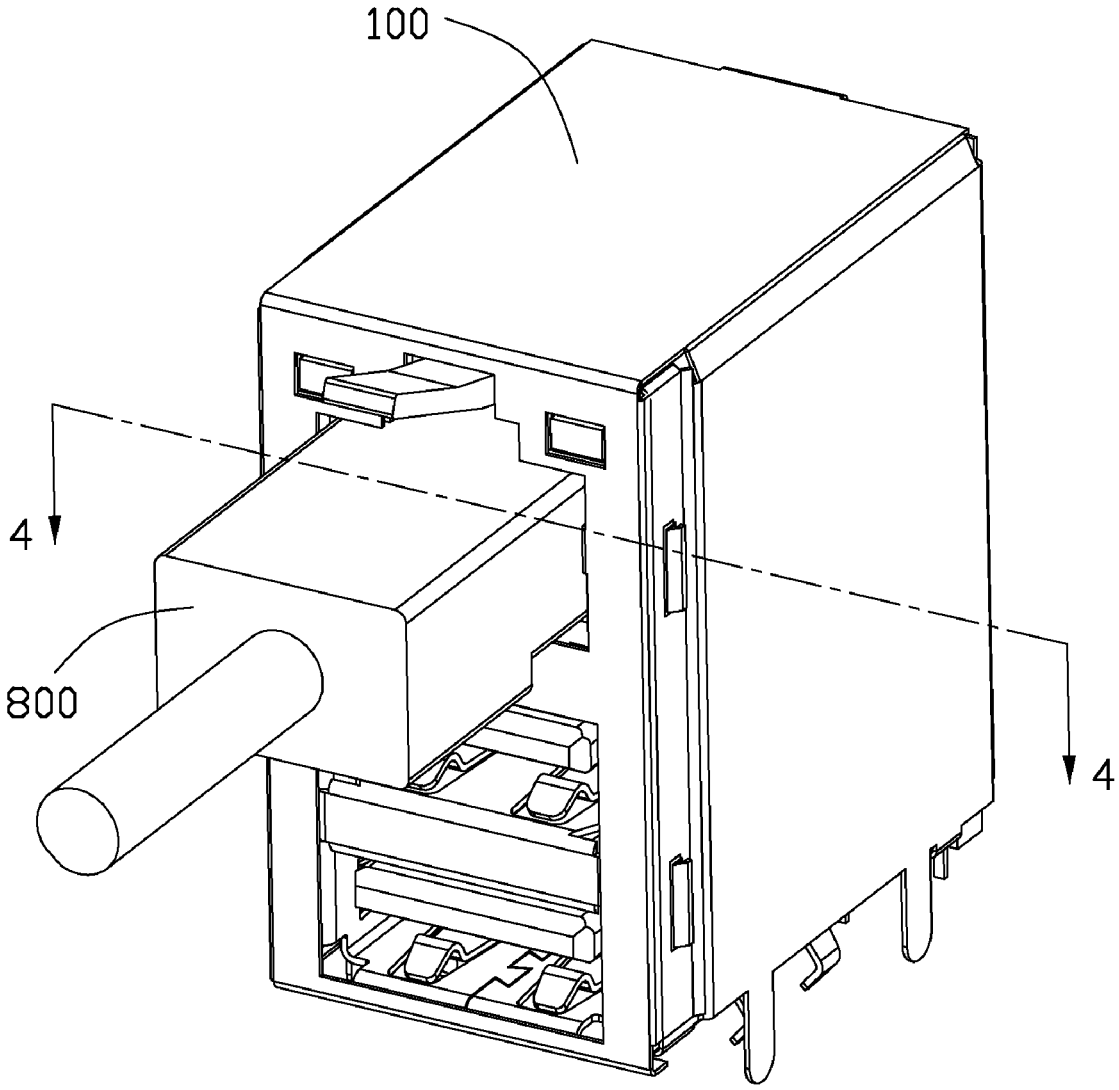
FIG. 1 is an assembled perspective view showing an electrical connector and a first plug in accordance with the present invention.

Reference will now be made in detail to the preferred embodiment of the present invention. Referring to FIGS. 1-4, an electrical connector 100 is a modular jack connector in this embodiment and is adapted for accommodating a first plug 800, i.e., a RJ45 plug, and is capable of blocking an insertion of a second plug 900, i.e., a USB plug. The electrical connector 100 comprises an insulative housing 1 defining a receiving cavity 11 and a retaining cavity 12 below the receiving cavity 11, a USB module 2 received in the retaining cavity 12, a contact module 3 assembled to the insulative housing 1, a pair of LEDs (Light Emitting Diodes) 4, and a shielding shell 5 attached to the insulative housing 1.

The insulative housing 1 includes an opening 10 communicating with the receiving cavity 11, a top wall 15, a pair of inserting recesses 13 recessed from the top wall 15, an inner wall 17 between the receiving cavity 11 and the retaining cavity 12, a pair of side walls 16, and a pair of blocking members 14 extending into the receiving cavity 11.

Figure 2:
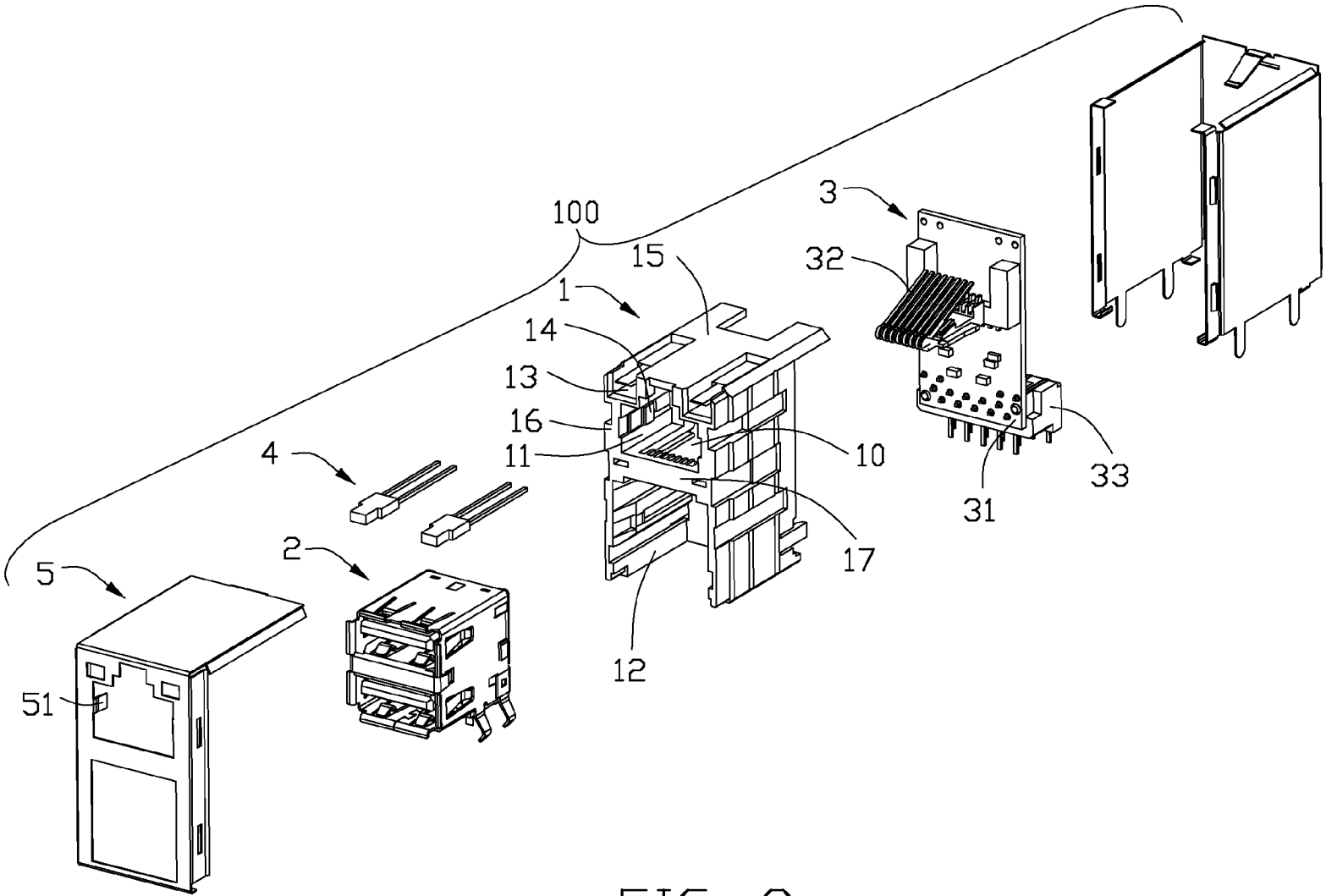
FIG. 2 is an exploded perspective view showing the electrical connector as shown in FIG. 1.
Figure 3:
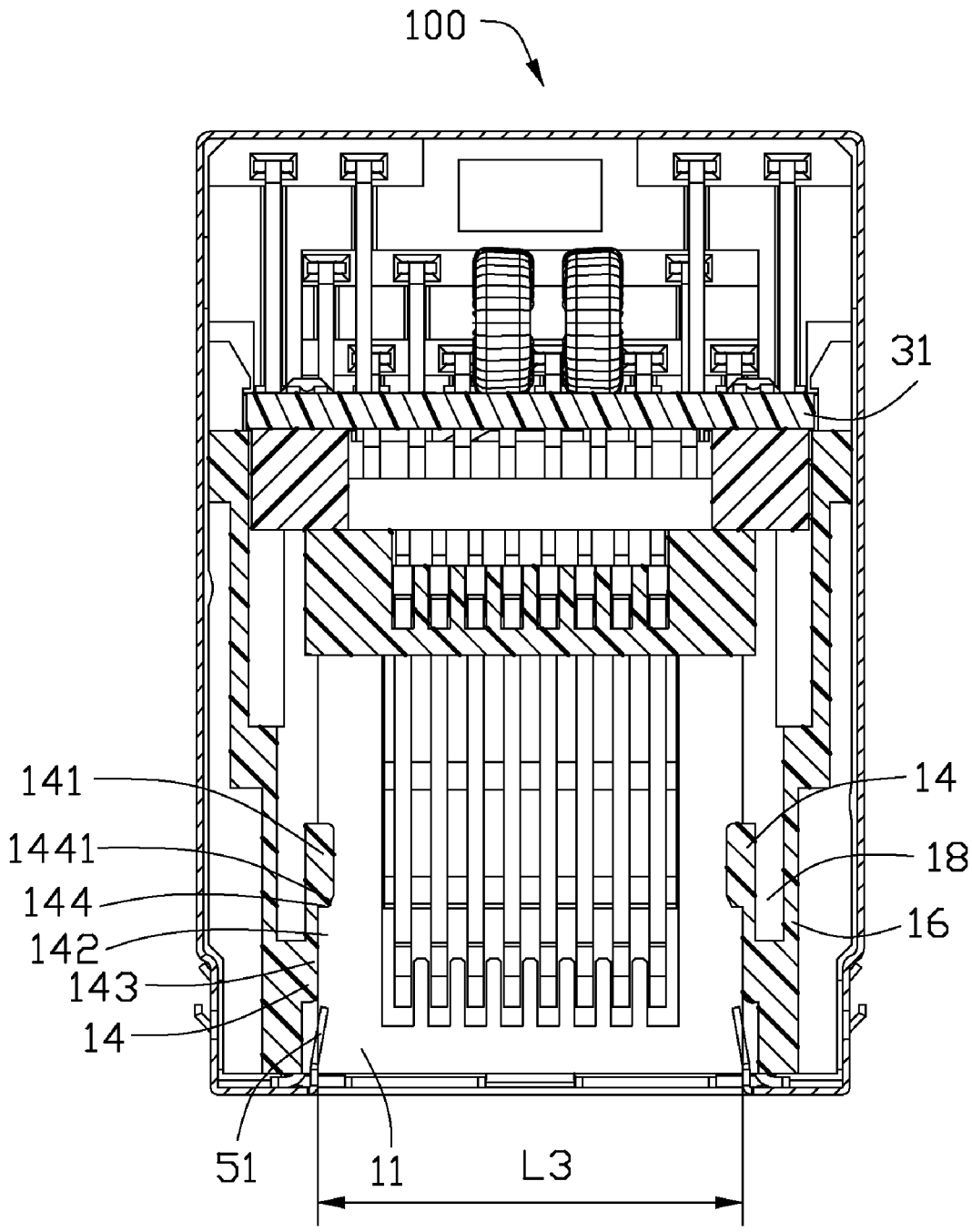
FIG. 3 is a cross-sectional view of the electrical connector, taken along line 4-4 of FIG. 1, with the first plug being removed.

Referring to FIGS. 2 and 3, the blocking members 14 and the insulative housing 1 are formed into a whole. Each blocking member 14 includes a root portion 143 connected with the side wall 16, a resilient portion 141 formed at a free end of the blocking member 14, and a platform 142 between the resilient portion 141 and the root portion 143. The root portion 143 and the platform 142 could be designated into a guiding portion (not labeled). The resilient portion 141 projects more inwardly than the platform 142. Therefore, the resilient portion 141 and the platform 142 have a shoulder portion 144 facing to the opening 10 formed therebetween. The shoulder portion 144 has a curved first corner 1441 formed thereon. The resilient portion 141 is separated from the side wall 16 to define a deforming space 18 between the resilient portion 141 and the side wall 16.

The contact module 3 comprises a paddle board 31, a plurality of contact terminals 32 assembled to a front side of the paddle board 31, and a converting module 33 attached to a rear side of the paddle board 31.

Referring to FIGS. 1-3, in assembling of the electrical connector 100, the contact module 3 is assembled from a rear side of the insulative housing 1, with the contact terminals 32 received in the receiving cavity 11. The USB module 2 is received in the retaining cavity 12. The pair of LEDs 4 are inserted in the inserting recesses 13. The shielding shell 5 is attached to the insulative housing 1. The shielding shell 5 is formed with a pair of guiding plates 51 extending into the opening 10 to a position adjacent to the root portions 143 of the blocking members 14.

Figure 4:
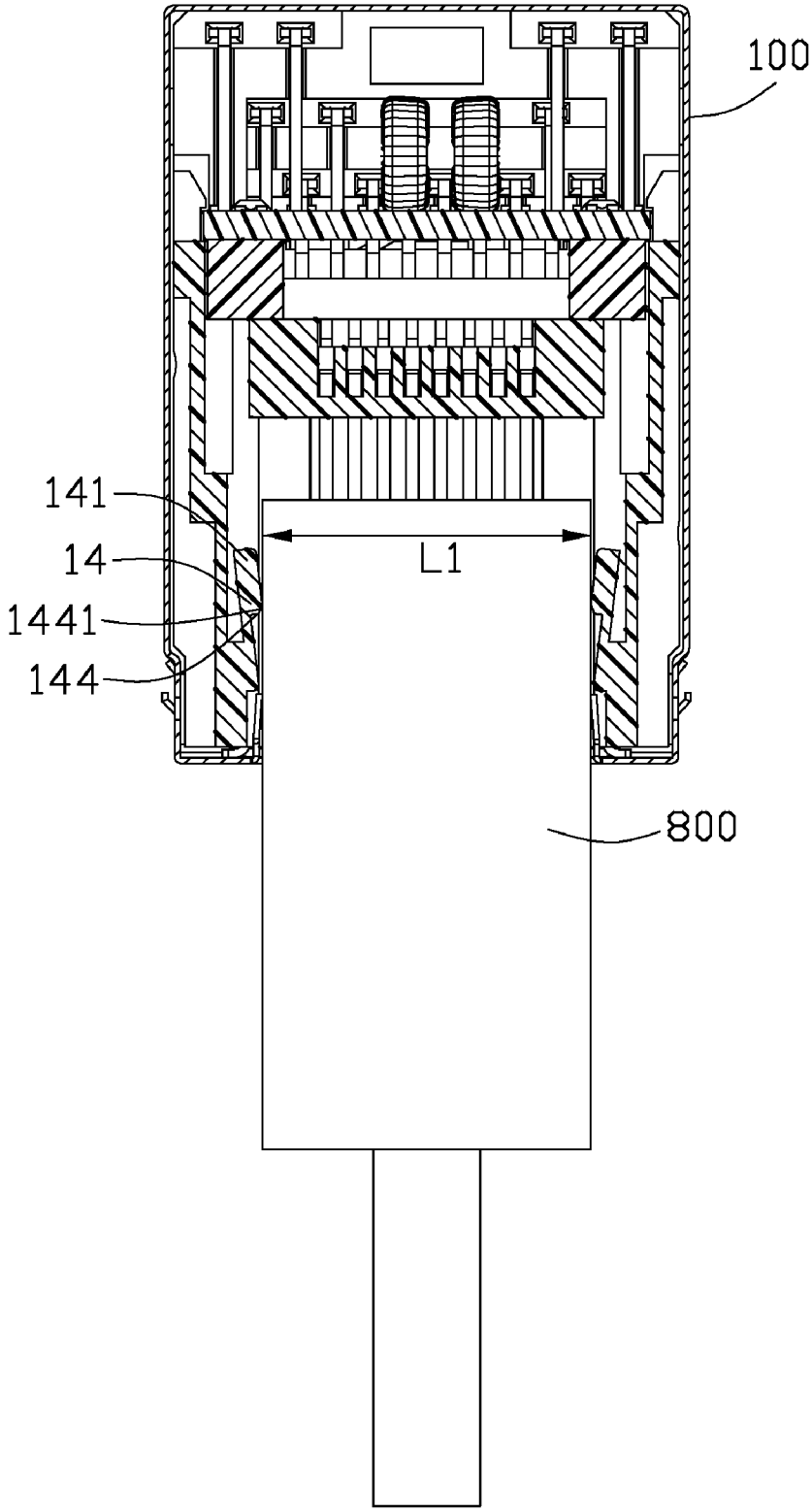
FIG. 4 is a cross-sectional view of the electrical connector and the first plug, taken along line 4-4 of FIG. 1, when the first plug is inserted to a final position within the receiving cavity.
Figure 5:
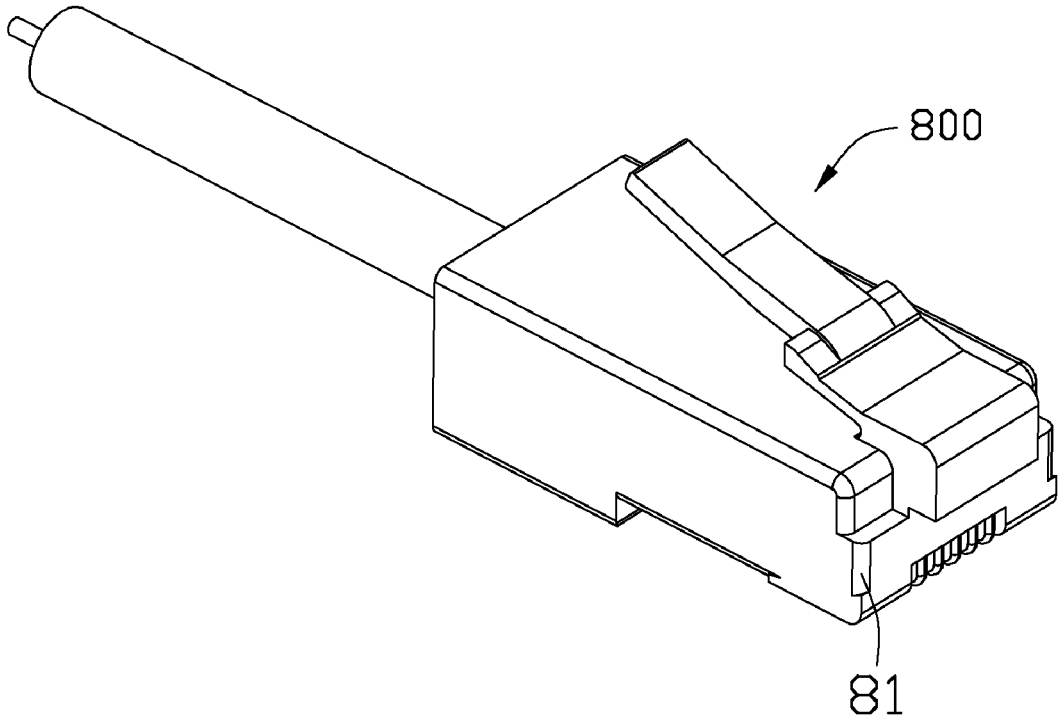
FIG. 5 is a perspective view of the first plug.

Referring to FIGS. 4 and 5, the first plug 800 has a first width L1 of about 11.68 mm and is formed with a curved second corner 81. Referring again to FIG. 3, a first distance L3 between the pair of platforms 142 of the pair of blocking members 14 is about 11.91 mm. The first width L1 is little less and could be regarded as not larger than the first distance L3, and is larger than another distance between the pair of resilient portions 141 of the pair of blocking members 14.

In the insertion process, the first plug 800 is inserted from the opening 10 via the guiding plates 51 to an initial position between the pair of platforms 142 of the pair of blocking members 14 and cooperates with the platforms 142. Along with the further insertion of the first plug 800, the pair of first corners 1441 of the pair of blocking members 14 are resisted against and pushed sidewardly by the second corner 81 of the first plug 800. The resilient portions 141 are depressed by the first plug 800 and become deformable toward the deforming space 18. The first plug 800 slides over the shoulder portions 144 to a final position within the receiving cavity 11 to contact with the contact terminals 32, as shown in FIG. 4.

Figure 6:
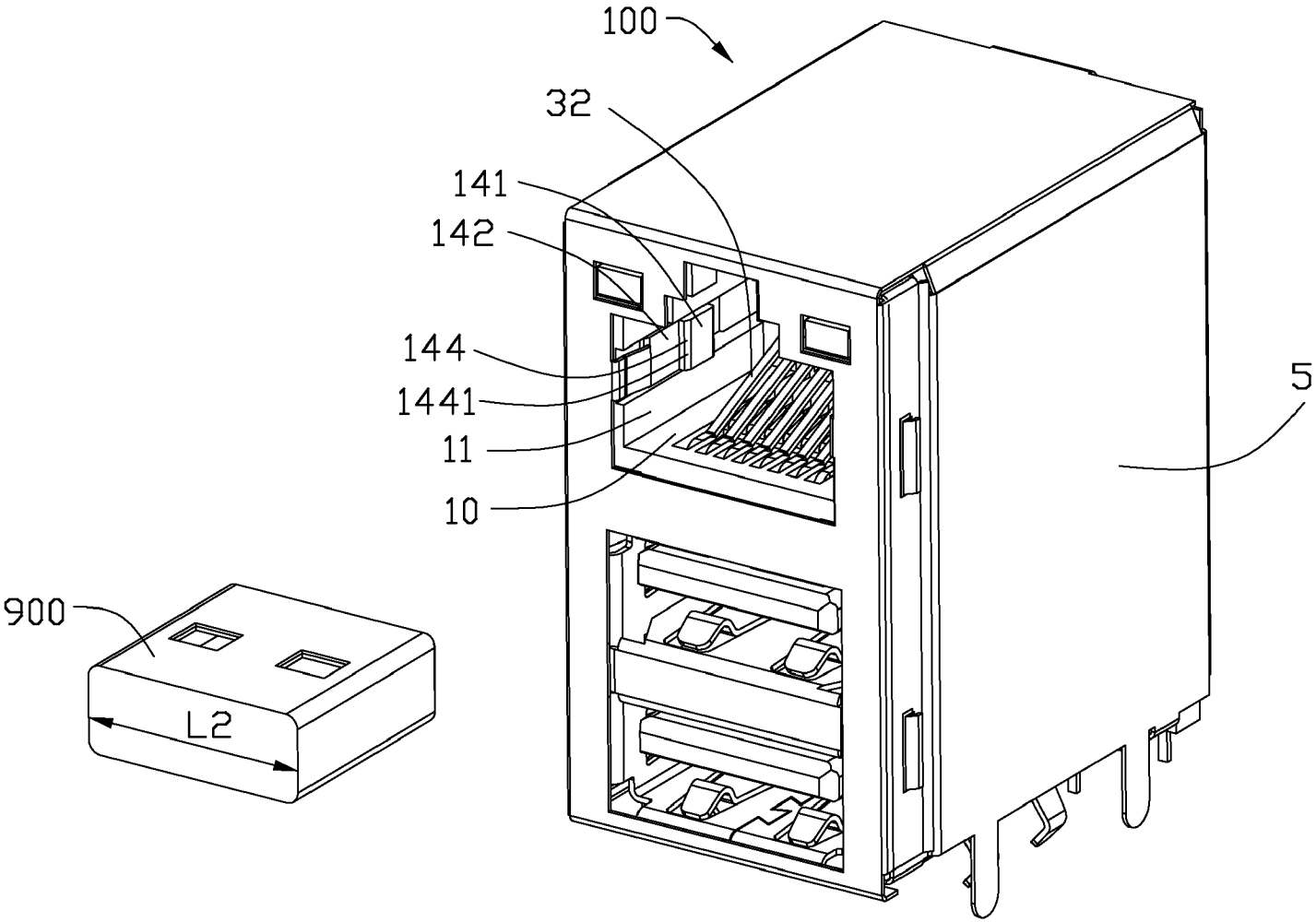
FIG. 6 is a perspective view showing the electrical connector and a second plug.

Referring to FIG. 6, the second plug 900 is a USB plug and has a width L2 of about 12.0 mm that is larger than either the first width L1 or the first distance L3 but does not have any curved corner formed thereon. When the second plug 900 is wrongly inserted through the opening 10 slightly obliquely, which aids in its wrong entering, the second plug 900 is blocked by the shoulder portions 144 of the blocking members 14. The resilient portions 141 would not have a deformation and thereby block the second plug 900 from further insertion.

The blocking members 14 could ease the insertion of the first plug 800, in virtue of the cooperation between the first and second corners 1441, 81 and the deformation of resilient portions 141. Additionally, the shoulder portions 144 of the blocking members 14 could block the insertion of the second plug 900. Therefore, it would prevent short circuit and would protect the second plug 900 from being destroyed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for insertion of a first plug along a mating direction, comprising:

an insulative housing comprising an opening, a receiving cavity and at least one blocking member provided in the receiving cavity, said at least one blocking member comprising a guiding portion adjacent to the opening, and a resilient portion projecting more inwardly to the receiving cavity along a transverse direction, which is perpendicular to the mating direction, than the guiding portion, to thereby form a shoulder portion facing to the opening between the guiding portion and the resilient portion, said resilient portion being deformable sidewardly along the transverse direction; and a contact module assembled to the insulative housing, wherein said shoulder portion of the at least one blocking member is formed with a first corner and the first plug is formed with a second corner, the first corner of the shoulder portion being resisted against by the second corner of the first plug to deform the resilient portion sidewardly along the transverse direction, for permitting the first plug inserting into a final position within the receiving cavity, wherein there are a pair of said blocking members, said pair of blocking members and the insulative housing being formed into a whole, wherein said insulative housing comprises a pair of side walls, the guiding portion of each blocking member comprising a root portion connected with the side wall, and a platform between the root portion and the resilient portion, wherein said resilient portion is separated from the side wall to form a deforming space between the resilient portion and the side wall, said resilient portion being deformable in the deforming space, wherein said pair of platforms of the pair of blocking members have a first distance therebetween, a first width of the first plug being not larger than said first distance, and larger than a distance between said pair of resilient portions, said first plug sliding over the shoulder portions to the final portion via the corporation between the first and second corners, wherein said shoulder portions of the pair of blocking members block an insertion of a second plug having a second width larger than both the first width and the first distance.

2. The electrical connector as claimed in claim 1, further comprising a shielding shell attached to the insulative housing.

3. The electrical connector as claimed in claim 2, wherein said shielding shell is formed with a pair guiding plates extending into the opening to a position adjacent to the guiding portions of the blocking members.

4. An electrical connector assembly comprising:

an insulative housing comprising an opening, a receiving cavity and a pair of blocking members provided in the receiving cavity, each blocking member comprising a guiding portion adjacent to the opening, and a resilient portion projecting more inwardly to the receiving cavity along a transverse direction perpendicular to the mating direction than the guiding portion, to thereby form a shoulder portion facing to the opening between the guiding portion and the resilient portion, said resilient portion being deformable sidewardly along the transverse direction;

a contact module assembled to the insulative housing; and a first plug having a first width not larger than a first distance between the pair of guiding portions and being insertable into the receiving cavity, wherein said shoulder portion of each blocking member is formed with a first corner and the first plug is formed with a second corner, the first corner of the blocking member being resisted against by the second corner of the first plug to have a deformation sidewardly along the transverse direction, for permitting the first plug inserting into a final position within the receiving cavity, wherein said insulative housing comprises a pair of side walls, the guiding portion of each blocking member comprising a root portion connected with the side wall, and a platform between the root portion and the resilient portion, said resilient portion separated from the side wall to form a deforming space between the resilient portion and the side wall, said resilient portion being deformable in the deforming space, wherein said shoulder portions of the pair of blocking members block an insertion of a second plug having a second width larger than both the first width and the first distance.

5. An electrical connector assembly comprising:

an insulative housing defining a receiving cavity;

a plurality of contacts disposed in the housing with contacting sections extending into the receiving cavity; and a pair of deflectable blocking members located by two lateral sides of the receiving cavity, said pair of blocking members defining a pair of shoulders facing toward an exterior, a pair of chamfers respectively located proximate and inside the corresponding shoulders and facing toward each other; wherein the pair of shoulders prevents a large plug, which is essentially dimensioned with a full transverse extent between the pair of blocking member, from being inserted into the receiving cavity due to two sides portions of the large plug being blocked by the shoulders while the pair of chamfers allows a small plug, which is essentially dimensioned little smaller than the large plug in a transverse direction, to be inserted into the receiving cavity due to confrontation with the pair of chamfers that facilitates outward deflection of the deflectable blocking members to have the pair of shoulder no longer block two side portions of the small plug, wherein the pair of blocking members defines a pair of blocking heads at corresponding free ends, respectively, where the shoulders and the chamfers are located, wherein a minimum distance between the pair of blocking heads is dimensioned to be larger than the small plug so as to assure the chamfers can work with the inserted small plug, wherein the minimum distance between the pair of blocking heads is little smaller than the full transverse extent between the pair of blocking members, wherein the small plug defines a pair of chamfers on two lateral sides for confrontation with the pair of chamfers of the blocking members.

* * * * *